US006305832B1

(12) United States Patent
Huang

(10) Patent No.: US 6,305,832 B1
(45) Date of Patent: Oct. 23, 2001

(54) DRINK STIRRER HAVING A LIGHT DEVICE

(76) Inventor: Jin Yu Huang, 7F, No. 46, Pin Ho 10 Street, Chang Hua (TW), 500

( * ) Notice: Subject to any disclaimer, the term of this patent is extended or adjusted under 35 U.S.C. 154(b) by 0 days.

(21) Appl. No.: 09/614,958

(22) Filed: Jul. 12, 2000

(51) Int. Cl.[7] ..... B01F 13/00
(52) U.S. Cl. ..... 366/129; 362/120
(58) Field of Search ..... 366/129, 142, 366/342, 343; D7/300.2; 362/109, 118–120

(56) References Cited

U.S. PATENT DOCUMENTS

D. 149,499 * 5/1948 Holden .
D. 301,104 * 5/1989 Hammerquist .
2,462,991 * 3/1949 Palinkas .
2,717,463 * 9/1955 Sindler .
2,723,111 * 11/1955 Lawrence .
2,793,842 * 5/1957 Bacon .
3,488,769 * 1/1970 Falkenberg .
3,510,643 * 5/1970 File .
3,772,809 * 11/1973 Schneller .
4,215,628 * 8/1980 Dodd, Jr. ..... 362/343
4,283,757 * 8/1981 Nalbandian et al. ..... 362/120
4,302,797 * 11/1981 Cooper ..... 362/119
4,483,622 * 11/1984 Muhi et al. ..... 366/129
4,530,606 * 7/1985 Hopkins et al. ..... 366/129
4,854,712 * 8/1989 Mori ..... 366/129
5,023,761 * 6/1991 De Lange ..... 362/120
5,151,720 * 9/1992 Kanbar ..... D7/300.2
5,626,414 * 5/1997 Chen ..... 362/119
5,713,664 * 2/1998 Harilela ..... 366/129
5,761,819 * 6/1998 Ledy-Gurren ..... 366/129
6,056,206 * 5/2000 Whiton ..... D7/300.2
6,106,132 * 8/2000 Chen ..... 362/118
6,129,473 * 10/2000 Shu ..... 362/118
6,135,606 * 10/2000 Fernandez et al. ..... 362/109
6,196,695 * 3/2001 Lai ..... 362/119

FOREIGN PATENT DOCUMENTS

2671332 * 7/1992 (FR) ..... 366/129

* cited by examiner

*Primary Examiner*—Charles E. Cooley

(57) ABSTRACT

A stirrer includes a rod for stirring a drink. a head secured onto the rod, a battery received in the head and having two electrodes. A light device has two prongs for coupling to the electrodes of the battery. One of the prongs may be selectively coupled to the battery and for selectively energizing the light device. The light emitted by the light device may be seen through the rod or the head. The head includes two casings secured together for retaining the battery or the light device within the head. The light device may be selectively actuated or energized by a switch.

6 Claims, 4 Drawing Sheets

DRINK STIRRER HAVING A LIGHT DEVICE

BACKGROUND OF THE INVENTION

1. Field of the Invention

The present invention relates to a stirrer, and more particularly to a stirrer for stirring the drink, such as the coffee, the cocktail, etc.

2. Description of the Prior Art

Typical stirrers comprise a rod body for engaging into the drink, such as the coffee, the cocktail, etc., and for stirring the drink. The stirrers are normally made of plastic materials by molding process. The typical stirrers may not attract peoples' attention.

The present invention has arisen to mitigate and/or obviate the afore-described disadvantages of the conventional stirrers.

SUMMARY OF THE INVENTION

The primary objective of the present invention is to provide a stirrer including a light device for lighting purposes and for generating attracting light to attract peoples' attention.

In accordance with one aspect of the invention, there is provided a stirrer comprising a rod for engaging with and for stirring a drink, the rod including a first end, a head secured onto the first end of the rod, at least one battery received in the head and including a first electrode and a second electrode, and a light device including a first prong coupled to the first electrode of the battery, and including a second prong selectively coupled to the second electrode of the battery and for selectively energizing the light device to emit the light through the head or the rod when the second prong is coupled to the second electrode of the battery.

The first end of the rod includes a cavity formed therein for receiving the light device. The first end of the rod includes an outer thread formed thereon, the head includes an inner thread formed therein and threaded with the outer thread of the rod for securing the head to the rod.

The head includes a first casing and a second casing secured together, the head includes a chamber formed therein for receiving the battery. The second casing includes at least one bulge extended inward of the chamber of the head, the stirrer further includes a switch slidably received in the chamber of the head and disposed between the second prong of the light device and the bulge, the switch is moved and forced to actuate the second prong to engage with the battery when the switch is moved over the bulge.

The second casing includes a channel formed therein, the switch includes a knob extended therefrom and slidably received in the channel of the second casing for moving the switch over the bulge. The second casing includes a peripheral shoulder and/or at least one orifice formed therein, the first casing includes a peripheral flange and/or at least one pin extended therefrom and engaged in the peripheral shoulder and/or the orifice of the second casing for securing the first casing and the second casing together.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
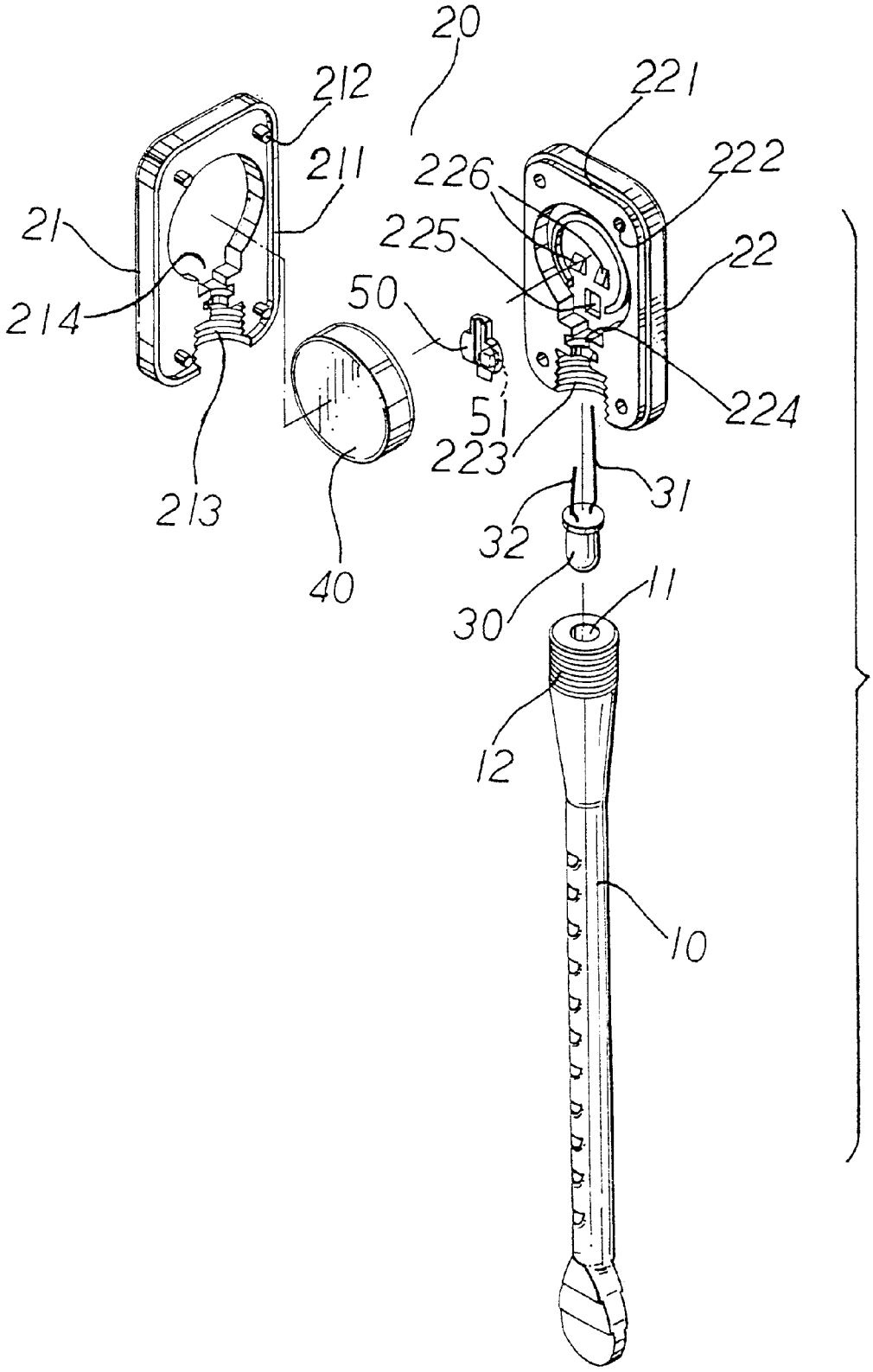
FIG. 1 is an exploded view of a stirrer in accordance with the present invention.
Figure 2:
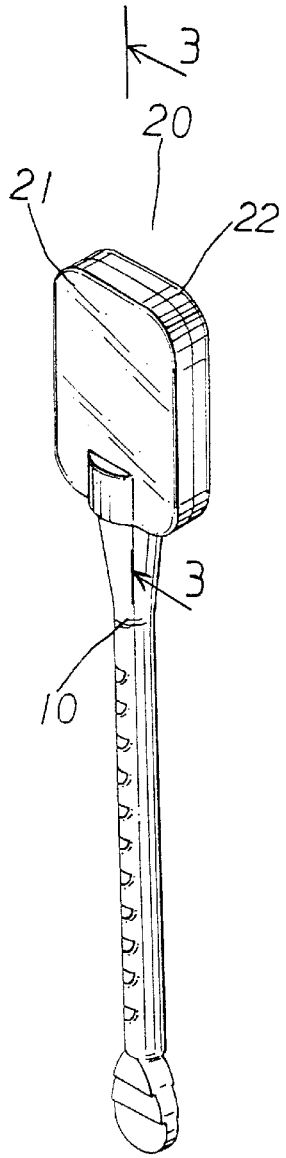
FIG. 2 is a perspective view of the stirrer.

Referring to the drawings, and initially to FIGS. 1–4, a stirrer in accordance with the present invention comprises a rod 10 for engaging into the drink, such as the coffee, the cocktail, etc., and for stirring the drink. The rod 10 includes an upper end having an outer thread 12 formed in the outer peripheral portion thereof and having a cavity 11 formed therein for receiving a light device 30, such as a liquid crystal displayer, a light emitting diode or a light bulb 30, therein. The light bulb 30 includes a pair of prongs 31, 32 extended therefrom for engaging with one or more batteries 40 (FIGS. 3, 4, 7, 8), such as for engaging with the case electrode and the center electrode of the batteries 40.

A head 20 includes two casings 21, 22 secured together for securing onto the upper end of the rod 10. The casing 22 includes a peripheral shoulder 221 formed in the outer peripheral portion thereof, and includes one or more orifices 222 formed therein. The other casing 21 includes a peripheral flange 211 extended outward from the outer peripheral portion thereof for engaging into the peripheral shoulder 221 of the casing 22 and for securing to the casing 22 with such as a force-fitted engagement. The other casing 21 may further include one or more pins 212 extended outward therefrom for engaging into the orifices 222 of the casing 22 respectively and for further securing to the casing 22 with such as a force-fitted engagement. The casing 21, 22 may further be solidly secured together with an ultrasonic welding process, for example. The head 20 includes an inner thread or a screw hole 213, 223 formed therein for threading with the outer thread 12 of the rod 10 and for securing the head 20 to the rod 10. The casings 21, 22 may each includes one half of the inner thread 213, 223 formed therein for forming the outer thread or the screw hole in the head 20 when the casings 21, 22 are secured together. The light bulb 30 is also relatively received in the casings 21, 22 of the head 20.

Figure 3:
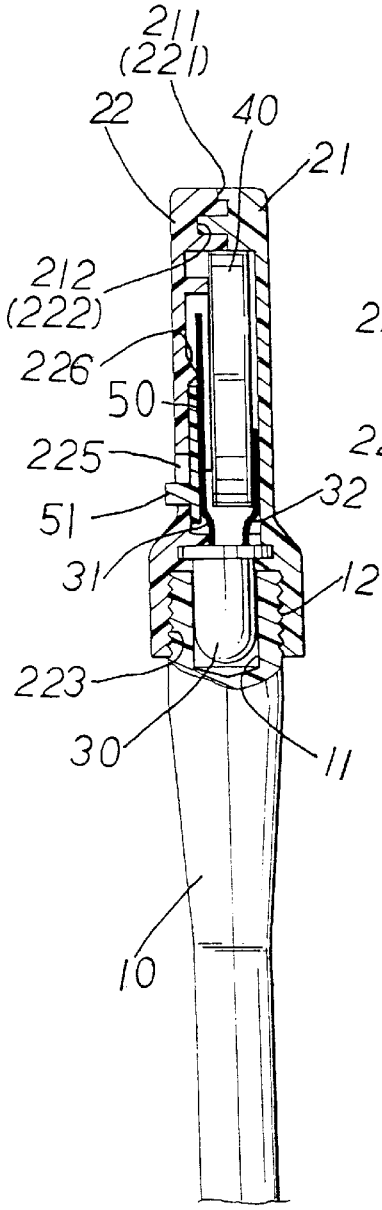
FIG. 3 is a cross sectional view taken along lines 3—3 of FIG. 2.

The casings 21, 22 each includes a chamber 214, 224 formed therein for receiving the battery or the batteries 40 therein. The casing 22 includes a channel 225 formed therein, and includes one or more bulges 226 extended inward of the chamber 224 thereof. An actuator or a switch 50 is slidably received in the chamber 224 of the casing 22 and disposed between the bulges 226 and the prong 31 of the light bulb 30, and includes a knob 51 slidably received in the channel 225 of the casing 22 and extended outward of the casing 22 via the channel 225 of the casing 22. The knob 51 may be moved along the channel 225 of the casing 22 to move the switch 50 over the bulges 226. As shown in FIG. 3, the prong 31 of the light bulb 30 is resilient and is normally disengaged from the center or the case electrode of the battery 40. When the switch 50 is forced to move over the bulges 226 by moving the knob 51 along the channel 225 of the casing 22, as shown in FIG. 4, the prong 31 of the light bulb 30 may be forced to engage with the center or the case electrode of the battery 40 by the switch 50, such that the light bulb 30 may be selectively energized by the battery 40 by the users.

Figure 4:
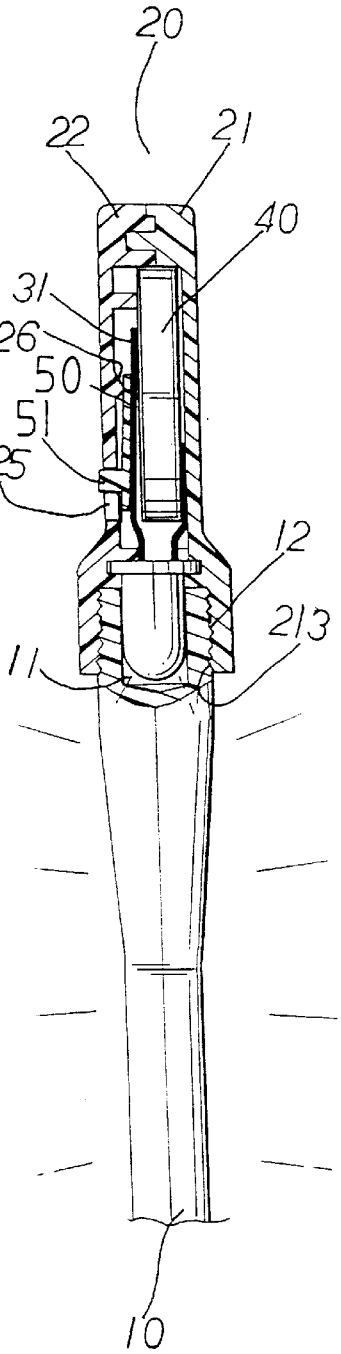
FIG. 4 is a cross sectional view similar to FIG. 3, illustrating the operation of the stirrer.
Figure 5:
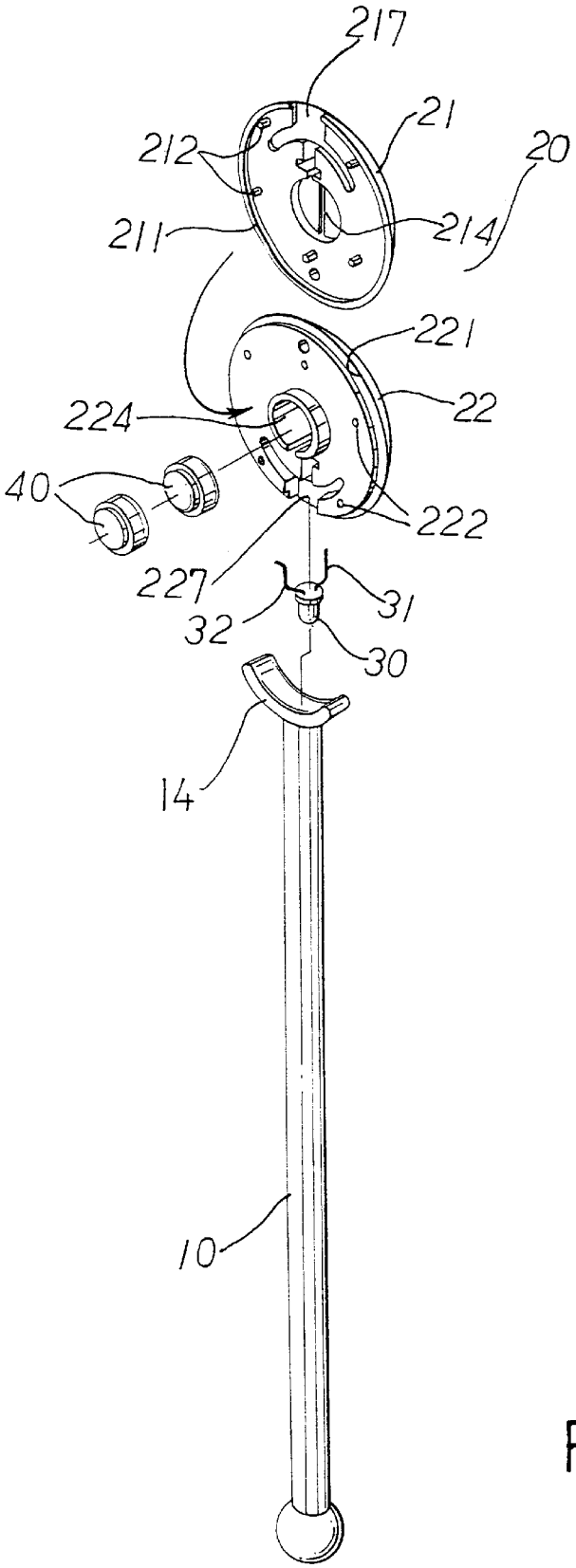
FIG. 5 is an exploded view illustrating the other application of the stirrer in accordance with the present invention.
Figure 6:
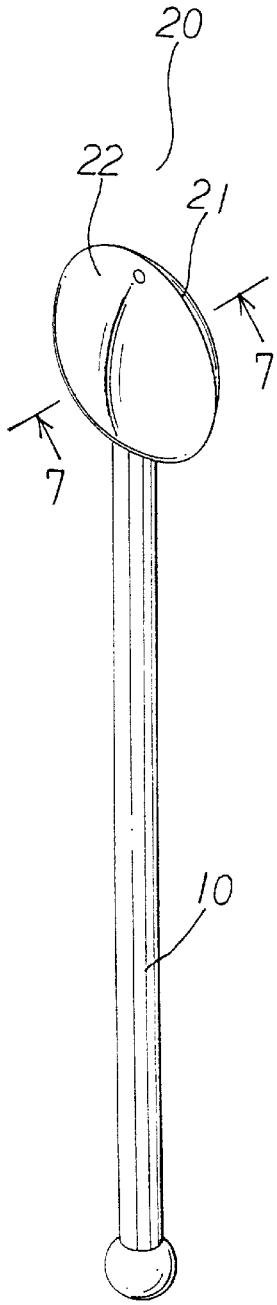
FIG. 6 is a perspective view of the stirrer as shown in FIG. 5.
Figure 7:
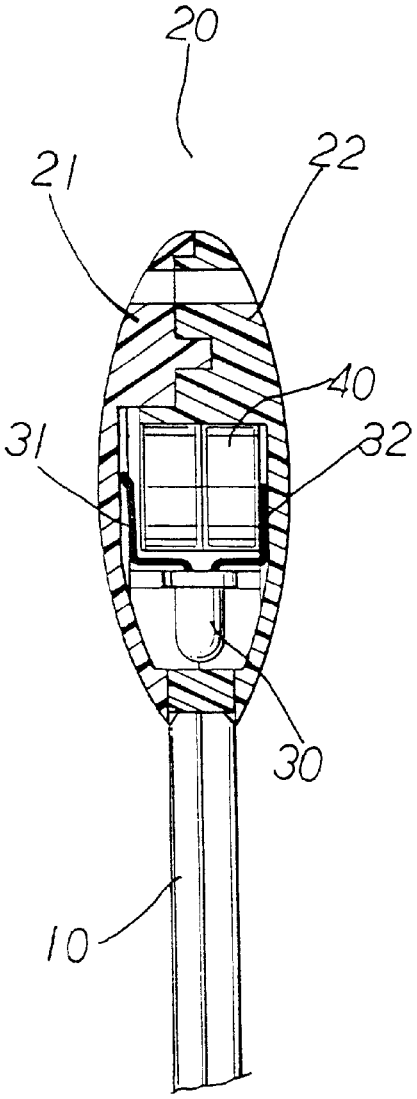
FIG. 7 is a cross sectional view taken along lines 7—7 of FIG. 6.
Figure 8:
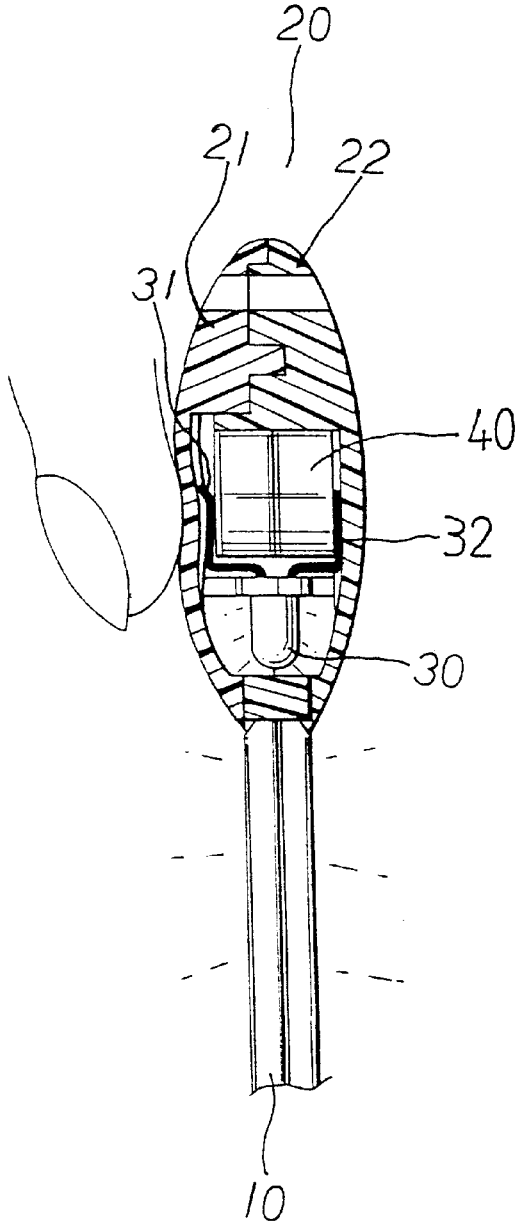
FIG. 8 is a cross sectional view similar to FIG. 7, illustrating the operation of the stirrer as shown in FIGS. 5–7.

In operation, as shown in FIG. 4, when the stirrer is used for stirring the drink, the coffee, the cocktail, or the like, the users normally hold or grasp the head 20. The users may thus easily use their finger to actuate or to move the switch 50 with the knob 51 thereof and to selectively actuate or energize the light bulb 30. The rod 10 and/or the casings 21, 22 of the head 20 are preferably made of plastic material that is transparent, such that the light emitted by the light bulb 30 may be seen through the rod 10 and/or the casings 21, 22 of the head 20.

Referring next to FIGS. 5–8, the head 20 may include the other shape, such as the circular shape as shown in FIGS. 5–8. Instead of the cavity 11 formed in the rod 10 as shown in FIGS. 3, 4, the casings 21, 22 each includes an opening 217, 227 formed therein for receiving the light bulb 30. The rod 10 may include an arm 14 provided on top thereof and engaged in the openings 217, 227 of the casings 21, 22 for securing the rod 10 to the casings 21, 22 of the head 20. Without the switch 50, one of the casings 21 may be made of a resilient material for allowing the wall of the casing 21 to be depressed inward of the chambers 214, 224 of the head 20 and for actuating the prong 31 of the light bulb 30 to engage with the case electrode or the center electrode of the battery 40. The light emitted by the light bulb 30 may also be seen through the casings 21, 22 of the head 20 and/or the rod 10 when the prong 31 of the light bulb 30 is forced to engage with the case electrode or the center electrode of the battery 40 by the users.

Accordingly, the stirrer in accordance with the present invention includes a light device for lighting purposes and for generating attracting light to attract peoples' attention.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stirrer comprising:

a rod for engaging with and for stirring a drink, said rod including a first end, a head secured onto said first end of said rod, said head including a first casing and a second casing secured together, said head including a chamber formed therein, said second casing including at least one bulge extended inward of said chamber of said head, at least one battery received in said chamber of said head and including a first electrode and a second electrode, a light device including a first prong coupled to said first electrode of said at least one battery, and including a second prong selectively coupled to said second electrode of said at least one battery and for selectively energizing said light device when said second prong is coupled to said second electrode of said at least one battery, and a switch slidably received in said chamber of said head and disposed between said second prong of said light device and said at least one bulge, said switch being moved and forced to actuate said second prong to engage with said at least one battery when said switch is moved over said at least one bulge.

2. The stirrer according to claim 1, wherein said first end of said rod includes a cavity formed therein for receiving said light device.

3. The stirrer according to claim 1, wherein said first end of said rod includes an outer thread formed thereon, said head includes an inner thread formed therein and threaded with said outer thread of said rod for securing said head to said rod.

4. The stirrer according to claim 1, wherein said second casing includes a channel formed therein, said switch includes a knob extended therefrom and slidably received in said channel of said second casing for moving said switch over said at least one bulge.

5. The stirrer according to claim 1, wherein said second casing includes a peripheral shoulder formed therein, said first casing includes a peripheral flange extended therefrom and engaged in said peripheral shoulder of said second casing for securing said first casing and said second casing together.

6. The stirrer according to claim 1, wherein said second casing includes at least one orifice formed therein, said first casing includes at least one pin extended therefrom and engaged in said at least one orifice of said second casing for securing said first casing and said second casing together.

* * * * *